US011060827B1

(12) United States Patent
Krueger

(10) Patent No.: US 11,060,827 B1
(45) Date of Patent: Jul. 13, 2021

(54) EXPLODING FOIL INITIATOR

(71) Applicant: HONEYWELL FEDERAL MANUFACTURING & TECHNOLOGIES, LLC, Kansas City, MO (US)

(72) Inventor: Daniel Scott Krueger, Liberty, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 0 days.

(21) Appl. No.: 16/922,292

(22) Filed: Jul. 7, 2020

(51) Int. Cl.
*F42B 3/12* (2006.01)

(52) U.S. Cl.
CPC ..... *F42B 3/125* (2013.01)

(58) Field of Classification Search
CPC ..... F42B 3/125
USPC ..... 102/202.7
See application file for complete search history.

(56) References Cited

U.S. PATENT DOCUMENTS 5,370,053 A 12/1994 Williams et al.
6,158,347 A 12/2000 Neyer et al.
7,236,345 B1 6/2007 Roesler et al.
7,581,496 B2 9/2009 Hennings et al.
7,938,065 B2 5/2011 Desai
8,191,477 B1 6/2012 Roesler
8,276,516 B1 10/2012 Nance et al.
8,485,097 B1 * 7/2013 Nance ..... F42B 3/18 102/202.7
9,500,448 B1 * 11/2016 Nance ..... F42B 3/11
9,568,288 B2 2/2017 Carpenter
9,791,248 B2 10/2017 Godfrey
2003/0200890 A1 * 10/2003 Reynolds ..... F42B 3/14 102/202.5
2007/0261584 A1 * 11/2007 Nance ..... F42B 3/14 102/202.8
2008/0134921 A1 * 6/2008 Nance ..... F42B 3/103 102/202.5
2008/0148982 A1 * 6/2008 Hennings ..... F42B 3/124 102/202.7
2009/0151584 A1 * 6/2009 Desai ..... F42B 3/121 102/202.7
2011/0072997 A1 * 3/2011 Nance ..... F42B 3/13 102/202.7
2015/0219428 A1 * 8/2015 Carpenter ..... F42B 3/124 102/202.7
(Continued)

*Primary Examiner* — Samir Abdosh
(74) *Attorney, Agent, or Firm* — Hovey Williams LLP

(57) ABSTRACT

An exploding foil initiator assembly is provided comprising a first layer of dielectric material, a second layer of dielectric material, a third layer of dielectric material, and a flyer. The first layer of dielectric material comprises a first pair of vias. The second layer of dielectric material comprises a first surface adjacent to the first layer of dielectric material, a second surface opposed to the first surface, a second pair of vias, and a bridge. Each of the second pair of vias extends from the first surface to the second surface and is in contact with one of the first pair of vias. The bridge is positioned on the second surface and is electrically connected to the second pair of vias. The third layer of dielectric material is positioned on the second surface of the second layer and comprises a bore positioned at least partially over the bridge forming a barrel. The flyer is positioned in the barrel on the bridge.

20 Claims, 4 Drawing Sheets

(56) References Cited

U.S. PATENT DOCUMENTS

2017/0045342 A1* 2/2017 Fisher ..... F42B 3/12

* cited by examiner

EXPLODING FOIL INITIATOR

STATEMENT REGARDING FEDERALLY-SPONSORED RESEARCH OR DEVELOPMENT

This invention was made with Government support under Contract No.: DE-NA-0002839 awarded by the United States Department of Energy/National Nuclear Security Administration. The Government has certain rights in the invention.

BACKGROUND

Exploding foil initiators are used in detonation systems to detonate explosive material. They each generally include a base, a bridge, flyer material positioned on the bridge, a barrel located above the bridge, and a cap. The base is attached to the rest of the detonation system using wire bonds on its top side or solder attachments on its back side. The solder attachments generally use plated, unfilled through vias and solder to attach the exploding foil initiator to the rest of the detonation system. An electrical charge is injected into the wire bonds and therefore the bridge to create a small plasma explosion at the bridge. The explosion propels the flyer through the barrel to the explosive charge.

To ensure complete and consistent detonation, the exploding foil initiator must be robust and must be able to sustain enough current to propel the flyer every time. Additionally, the exploding foil initiator must be compact so that it can fit on the detonation system and efficiently utilize space. However, the solder attachments and wire bonds have regions that are relatively thin, which limit the amount of electrical current that can be delivered to the bridge. Additionally, the points of attachment to the detonation system are often directly in the location of the vias, which leads to cracking and failure due to thermal and mechanical stresses of the attachment process.

The background discussion is intended to provide information related to the present invention which is not necessarily prior art.

SUMMARY

The present invention solves the above-described problems and other problems by providing an exploding foil initiator that is more compact and reliable and a method for building the same.

An exploding foil initiator assembly constructed in accordance with an embodiment of the invention comprises a first layer of dielectric material, a bridge, a second layer, a first via, a second via, and a flyer. The first layer of dielectric material comprises a first surface and a second surface opposed to the first surface. The bridge is positioned on the second surface. The second layer of dielectric material is positioned adjacent to the second surface of the first layer and comprises a bore located at least partially over the bridge to form a barrel. The first via and the second via are electrically connected to each other through the bridge. The first via extends along a first axis and the second via extends along a second axis. Each of the first via and the second via are located in one of the first layer or the second layer provided that the bridge is at least part of the electrical connection between the first via and the second via. The flyer is positioned in the barrel on the bridge.

An exploding foil initiator assembly constructed in accordance with another embodiment of the invention comprises a first layer of dielectric material, a second layer of dielectric material, a third layer of dielectric material, and a flyer. The first layer of dielectric material comprises a first via. The second layer of dielectric material comprises a first surface adjacent to the first layer of dielectric material, a second surface opposed to the first surface, a second via extending from the first surface to the second surface and electrically connected to the first via, and a bridge positioned on the second surface and electrically connected to the second via. The third layer of dielectric material is positioned on the second surface of the second layer and comprises a bore located at least partially over the bridge forming a barrel. The flyer is positioned in the barrel on the bridge.

A method of manufacturing an exploding foil initiator assembly, the method comprising: boring a hole in a first layer of dielectric material; depositing electrically conductive build material in the hole of the first layer; boring a hole in a second layer of dielectric material; depositing electrically conductive build material in the hole of the second layer; depositing electrically conductive build material on the second layer to form a bridge that is electrically connected to the second via; boring a hole in a third layer of dielectric material to form a barrel; arranging the first layer adjacent to the second layer so that the first via is electrically connected to the second via; arranging the second layer adjacent to the third layer so that the hole of the third layer is at least partially over the bridge to form a stack; heating the stack so that the first layer and third layer fuse to the second layer; and depositing a polymer on the bridge to form a flyer. By forming the vias in this manner, the vias may be positioned away from attachment points, such as by staggering the vias and/or forming a blind via, to deliver electricity to the bridge. The vias can have higher current capacity, and the first layer of dielectric material insulates the other layers which prevents damage during attachment processes. Additionally, the resulting exploding foil initiator assembly can be monolithic, which makes it more compact and space efficient.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
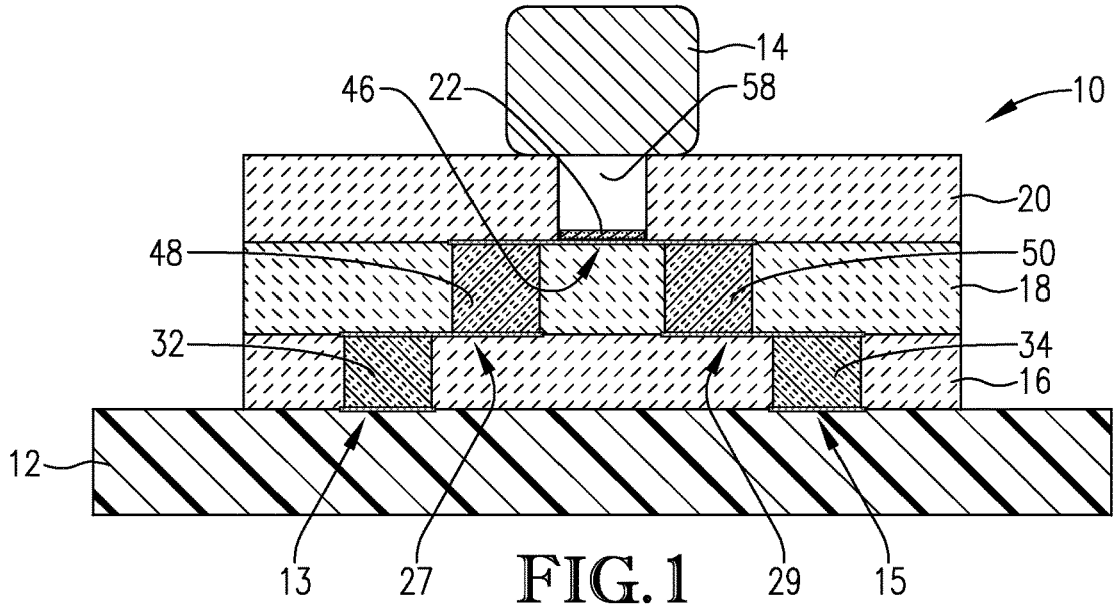
FIG. 1 is a perspective view of an exploding foil initiator system constructed in accordance with embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
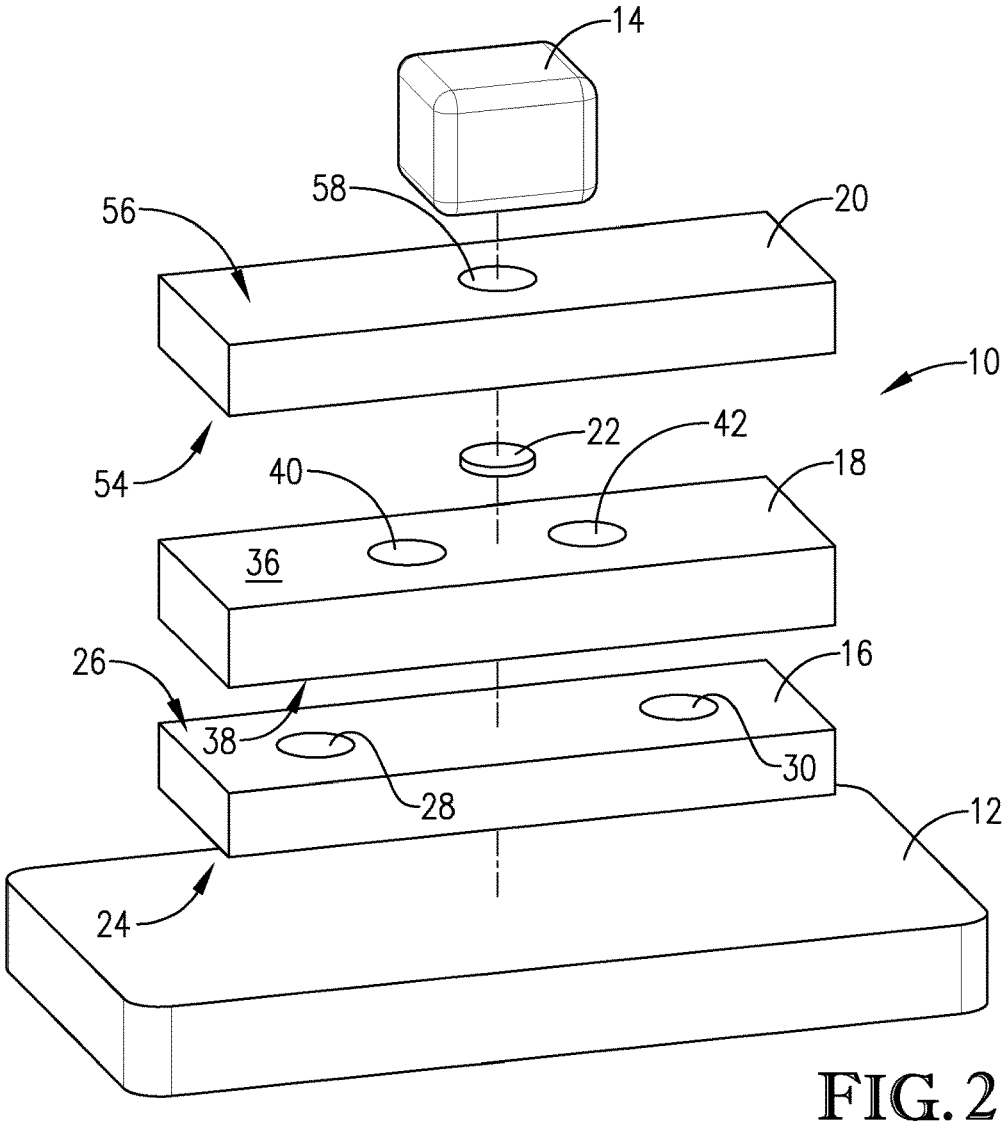
FIG. 2 is an exploded view of the exploding foil initiator system of FIG. 1.
Figure 3:
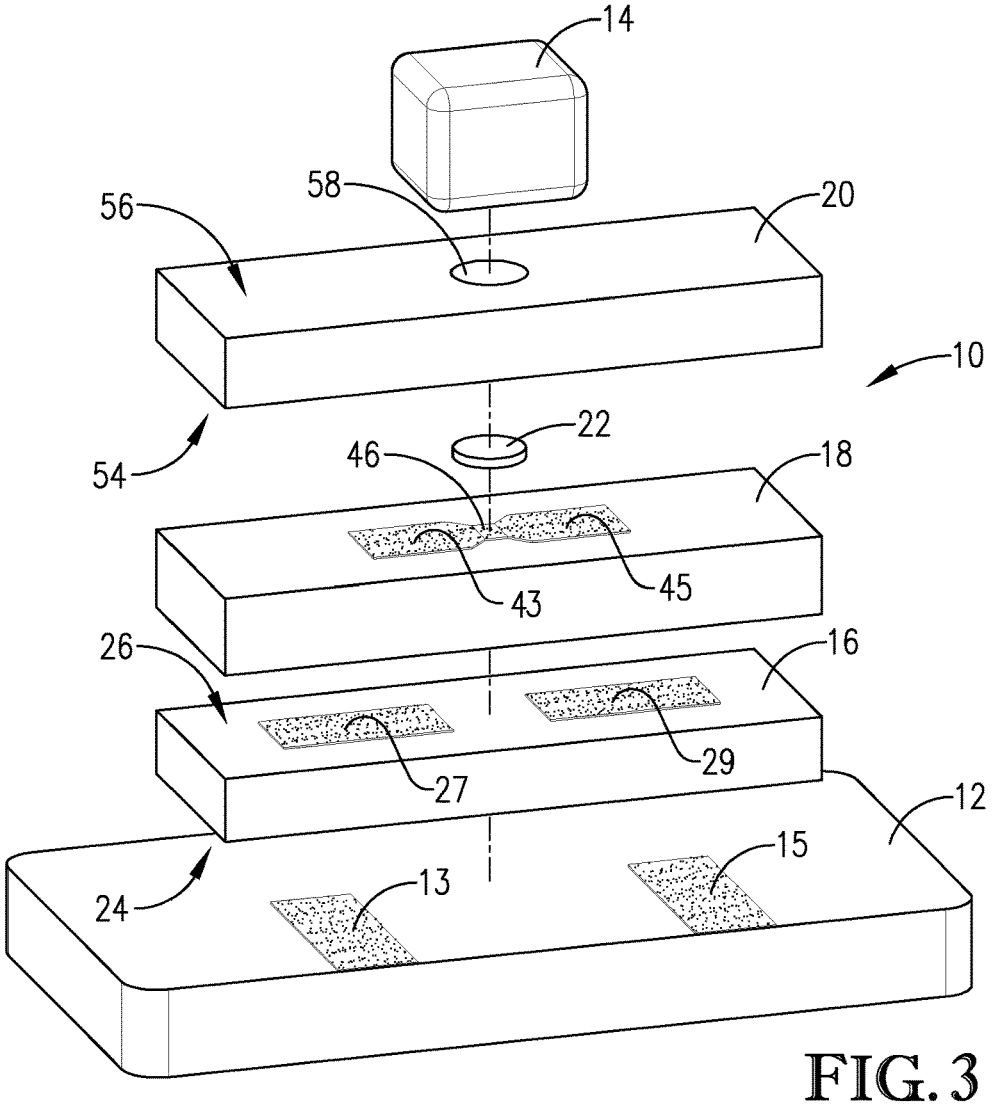
FIG. 3 is an exploded view of the exploding foil initiator system of FIG. 2 showing conductive material.

Turning to FIGS. 1-3, an exemplary exploding foil initiator assembly 10 constructed according to an embodiment of the present invention is depicted. The assembly 10 is positioned on a mounting surface 12 and is configured to detonate an explosive charge 14. The mounting surface 12 may be part of a flex circuit, a housing, or the like and include one or more metal traces 13, 15, wires, or the like. The explosive charge 14 comprises explosive material and may be the main explosive component in a bomb, missile, mine, rocket, or the like, or may be a stage in such a device. The assembly 10 broadly comprises a first layer 16 of dielectric material, a second layer 18 of dielectric material adjacent to the first layer 16, a third layer 20 of dielectric material adjacent to the second layer 18, and a flyer 22. The layers 16, 18, 20 may be formed of any dielectric materials such as ceramic material and/or a ceramic-loaded polymer and/or a fiberglass reinforced polymer. The ceramic material may include high temperature co-fired ceramic or preferably low temperature co-fired ceramic. The ceramic material yields improved durability and insulation properties, which allow for higher electric currents to be used for initiation, thereby increasing the reliability of the assembly 10.

The first layer 16 comprises a first surface 24, a second surface 26, a pair of holes 28, 30 extending between the surfaces 24, 26, a pair of vias 32, 34 formed in the holes 28, 30, and a pair of conductive paths 27, 29 extending from the vias 32, 34. The first surface 24 may be attached to the mounting surface 12. The second surface 26 of the first layer 16 provides a platform for attaching the second layer 18 of dielectric material.

The pair of holes 28, 30 of the first layer 16 extend from the first surface 24 to the second surface 26 of the first layer 16 and form and support the vias 32, 34. The holes 28, 30 may be spaced apart at a certain distance. For example, the distance between the holes 28, 30 and therefore the vias 32, 34 may be the same distance as the distance between the traces 13, 15. Electrically conductive build material may be deposited in the holes 28, 30 to form the vias 32, 34. The vias 32, 34 may be electrically connected to conductive material located on or in the mounting surface 12, such as metal traces 13, 15, wires, or the like. The build material forming the vias 32, 34 may comprise metal (such as gold, platinum, silver, copper, aluminum, etc.), conductive carbon material, or similar conductive material. The holes 28, 30, and therefore the vias 32, 34, may have any size, shape, and orientation (such as angle relative to the first and/or second surfaces 24, 26). For example, the holes 28, 30 and therefore the vias 32, 34 may be generally perpendicular to the first and second surfaces 24, 26. The holes 28, 30 may also be located anywhere in the first layer 16.

The conductive paths 27, 29 are positioned between the first layer 16 and the second layer 18 and provide electrical paths between the vias 32, 34 of the first layer 16 and vias of the second layer 18 (discussed further below). The conductive paths 27, 29 may comprise any conductive material, as discussed above, and have any length without departing from the scope of the present invention. Additionally, the vias 32, 34 may be spaced apart at any distance without departing from the scope of the present invention. The first layer 16 may have any number of holes and vias without departing from the scope of the present invention. For example, the first layer 16 may only have one hole/via or it may have three or more holes/vias.

In some embodiments, one or more pins may be attached to the first surface 24 of the first layer 16 for attaching the assembly 10 to the mounting surface 12. Additionally or alternatively, one or more conductive pins may be attached to the vias 28, 30 of the first layer 16 for attaching the assembly 10 to the base as well as conducting electricity to the vias 28, 30. The first layer 16 insulates the second layer 18 from attachment processes, which involves significant heat. Without the insulation layer 16, the heat from the attachment process may cause warping, cracking, and/or other damage to the second layer 18 and/or components attached thereto. Such damage would increase the risk of the assembly 10 failing to detonate the explosive charge 14. Thus, the first layer 16 improves the reliability of the system 10.

The second layer 18 is positioned adjacent to the second surface 26 of the first layer 16 and comprises a first surface 36, a second surface 38 opposed to the first surface 36, a pair of holes 40, 42 extending between the surfaces 36, 38, a pair of vias 48, 50 in the holes 40, 42, a pair of conductive paths 43, 45, and a bridge 46. The first surface 36 is adjacent to the second surface 26 of the first layer 16 and may be attached thereto.

The holes 40, 42 extend from the first surface 36 to the second surface 38 of the second layer 18 and help form and support the vias 48, 50. The holes 40, 42 may also be located anywhere on the second layer 18 and at any location relative to the first layer 16. For example, the holes 40, 42 may be positioned directly above and aligned with holes 28, 30. Alternatively, the holes 40, 42 may have different diameters than holes 28, 30 and/or be in staggered positions relative to holes 28, 30. The distance between the holes 40, 42 of the second layer 18 may be smaller or larger than the distance between the holes 28, 30 of the first layer 16. Staggering the holes 28, 30, 40, 42 and therefore the vias 32, 34, 48, 50, allows the attachment points to be located away from the vias to avoid cracking and failure of the assembly 10.

Each of the vias 48, 50 are electrically connected to one of the vias 32, 34 of the first layer 16. For example, each of the vias 48, 50 may be connected to one of the conductive paths 27, 29. In some embodiments, each of the vias 48, 50 may be physically in contact with and/or bonded to one of the vias 32, 34 of the first layer 16. The conductive material forming the vias 48, 50 also comprises conductive material, as discussed above. The holes 40, 42, and therefore the vias 48, 50, may have any size, shape, and orientation (such as extending at an angle relative to the first layer 16) without departing from the scope of the present invention. In preferred embodiments, the holes 40, 42 and therefore the vias 48, 50 are substantially orthogonal to the first layer 16. Additionally, the second layer 18 may have any number of holes and vias without departing from the scope of the present invention. For example, the second layer 18 may only have one hole/via or it may have three or more holes/vias.

The pair of conductive paths 43, 45 are electrically connected to the vias 48, 50 and are positioned between the second layer 18 and the third layer 20. The paths 43, 45 provide electrical paths between the vias 48, 50 of the second layer 18 and the bridge 46. The conductive paths 43, 45 may comprise any conductive material, as discussed above, and have any length without departing from the scope of the present invention.

The bridge 46 is connected to the conductive paths 43, 45 and is operable to receive an amount of electric current that causes it vaporize. The bridge 46 may be positioned on the second surface 36. When the bridge 46 vaporizes, plasma is created, which forms pressure under the flyer 22 and propels the flyer 22 into the explosive charge 14.

The third layer 20 is positioned between the second layer 18 and the explosive charge 14 and comprises a first surface 54, a second surface 56, and a hole 58 extending between the surfaces 54, 56. The first surface 54 is adjacent to the second surface 36 of the second layer 18 and may cover the vias 48, 50 of the second layer 18 and/or a portion of the conductive paths 43, 45. The second surface 56 is opposed to the first surface 54 and is adjacent to the explosive charge 14. The second surface 56 may be attached to the explosive charge 14 and/or another component. The hole 58 provides a barrel for the flyer 22 to travel through when the bridge 46 ignites. The hole 58 extends from the first surface 54 to the second surface 56 and is at least partially aligned with the bridge 46. In preferred embodiments, the hole 58 is located relative to the second layer 18 so that the bridge 46 is at the center of the hole 58.

The assembly 10 may have any number of layers of dielectric material without departing from the scope of the present invention. For example, the first layer 16 may be removed so that the second layer 18 is attached to the mounting surface 12. Additional layers may also be added, such as layers similar to the first layer 16 so that, for example, staggered vias may meander through the assembly 10 to connect to the vias 48, 50 of the second layer 18. Additionally, multiple layers similar to the third layer 20 may be added to lengthen the barrel of the assembly 10.

The flyer 22 is operable to be propelled through the hole 58 of the third layer 20 and strike the explosive charge 14. The flyer 22 is positioned on the second layer 18 above the bridge 46 and inside the hole 58. The flyer 22 may comprise polymer material, such as polyimide.

The above-described exploding foil initiator assembly 10 and other embodiments of the assembly 10 may be implemented in a detonation assembly. The vias 28, 30 of the first layer 16 are electrically connected to the vias 40, 42 of the second layer 18, which are electrically connected to the bridge 46. To detonate the explosive charge 14, a voltage is applied to the vias 28, 30 of the first layer 16 so that electric current travels through them. The current passes through the vias 40, 42 of the second layer 18 and through the bridge 46. The current is high enough tot convert the bridge 46 to a plasma. The plasma creates a pressure between 36 and 22 that propels the flyer 22 through the hole 58 of the third layer 20 so that it strikes the explosive charge 14, thereby detonating it.

Figure 4:
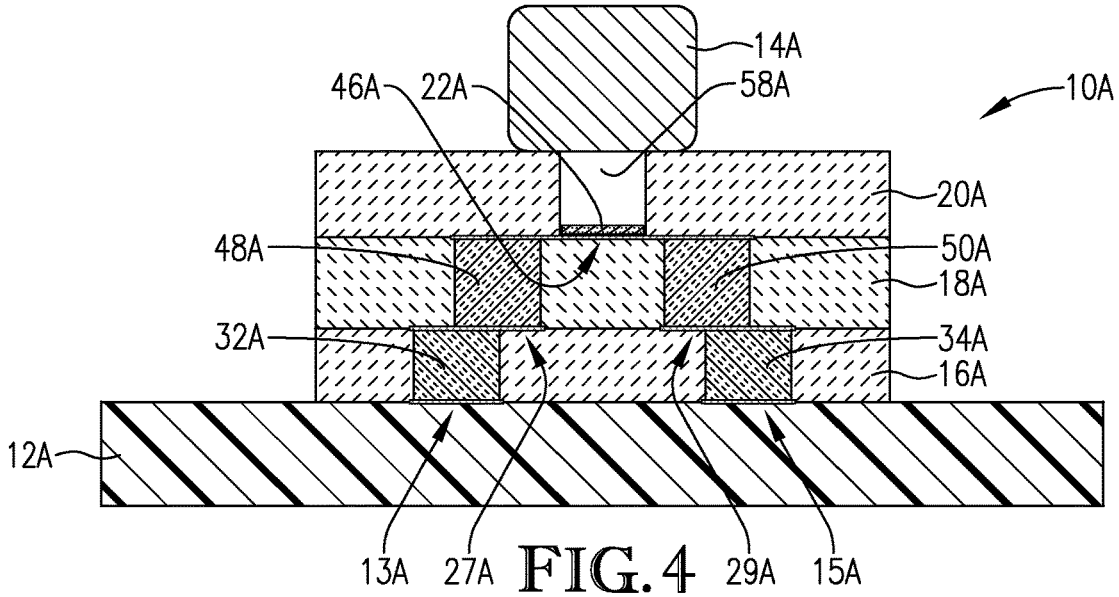
FIG. 4 is a perspective view of an exploding foil initiator system constructed in accordance with another embodiment of the present invention.

An exploding foil initiator assembly 10A constructed in accordance with another embodiment of the invention is depicted in FIG. 4. The assembly 10A may comprise substantially similar components as assembly 10; thus, the components of assembly 10A that correspond to similar components of assembly 10 have an 'A' appended to their reference numerals.

The assembly 10A includes all the features of assembly 10 except that the vias 48A, 50A are spaced farther apart and therefore overlap a portion of the vias 32A, 34A. The conductive paths 27A, 29A are therefore slightly shorter but are still positioned between the vias 48A, 50A and vias 32A, 34A.

Figure 5:
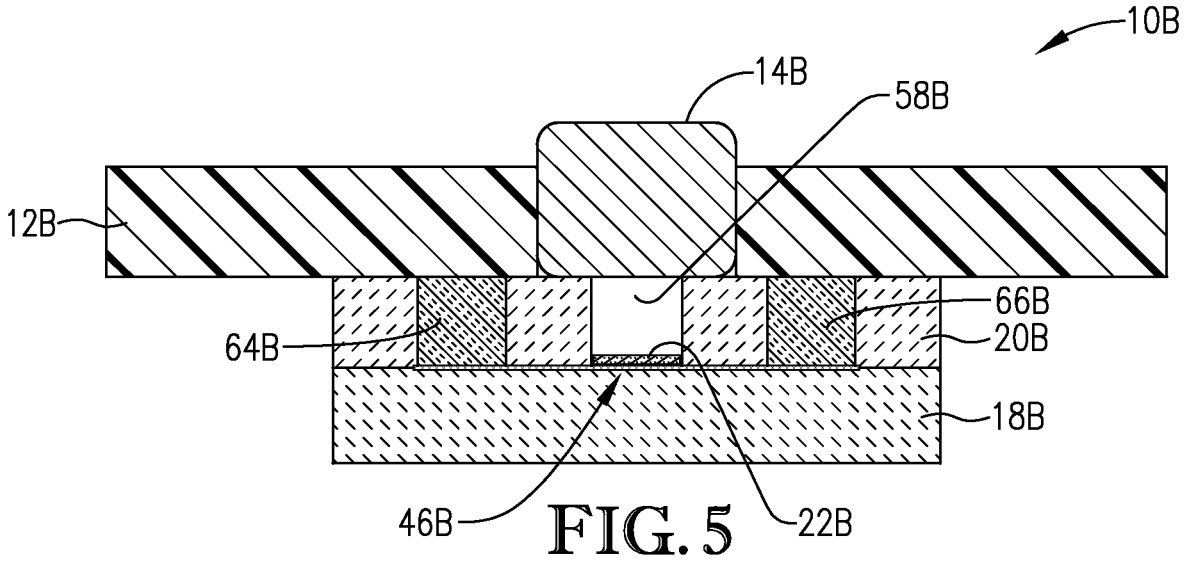
FIG. 5 is a perspective view of an exploding foil initiator system constructed in accordance with another embodiment of the present invention.

An exploding foil initiator assembly 10B constructed in accordance with another embodiment of the invention is depicted in FIG. 5. The assembly 10B may comprise substantially similar components as assembly 10; thus, the components of assembly 10B that correspond to similar components of assembly 10 have a 'B' appended to their reference numerals.

The assembly 10B includes all the features of assembly 10 except that assembly 10B optionally does not include the first layer 16, the second layer 18B does not have vias 48B, 50B, and third layer 20B comprises holes 60B, 62B extending between the surfaces 54B, 56B and vias 64B, 66B formed therein. The vias 64B, 66B may be connected to pins attached to the mounting surface 12B. The vias 64B, 66B may also be located anywhere on the third layer 20B and at any location relative to the second layer 18B. The vias 64B, 66B are aligned with conductive paths 27B, 29B. The conductive paths 27B, 29B are positioned between the second layer 18B and the third layer 20B and extend to and are electrically connected to the bridge 46B.

Figure 6:
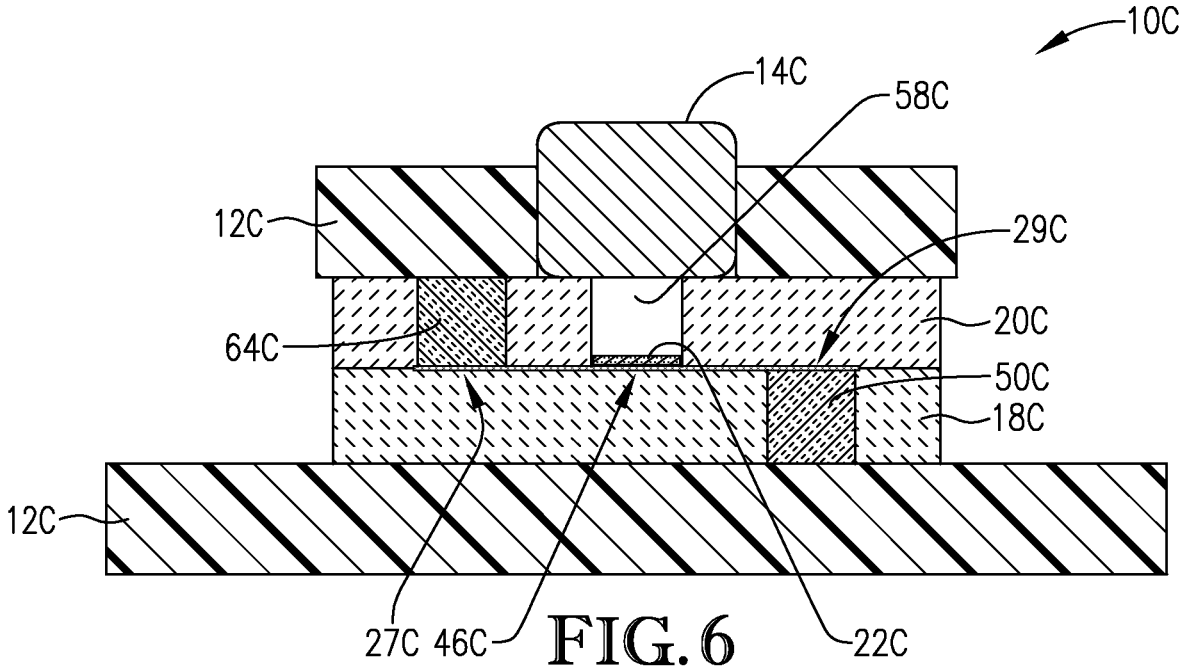
FIG. 6 is a perspective view of an exploding foil initiator system constructed in accordance with another embodiment of the present invention.

An exploding foil initiator assembly 10C constructed in accordance with another embodiment of the invention is depicted in FIG. 6. The assembly 10C may comprise substantially similar components as assembly 10; thus, the components of assembly 10C that correspond to similar components of assembly 10 have a 'C' appended to their reference numerals.

The assembly 10C includes all the features of assembly 10 except that assembly 10C optionally does not include the first layer 16 (though in some embodiments, a first layer may be provided and have a via electrically connected to a via of the second layer), the second layer 18C comprises via 50C, and third layer 20C comprises via 64C. The vias 50C, 64C may also be located anywhere in their respective third layers 18C, 20C. The vias 50C, 64C are aligned with conductive paths 27C, 29C. The via 64C of the third layer 20C may be connected to one or more pin on the substrate 12C. The conductive paths 27C, 29C are positioned between the second layer 18C and the third layer 20C and extend to and are electrically connected to the bridge 46C.

Figure 7:
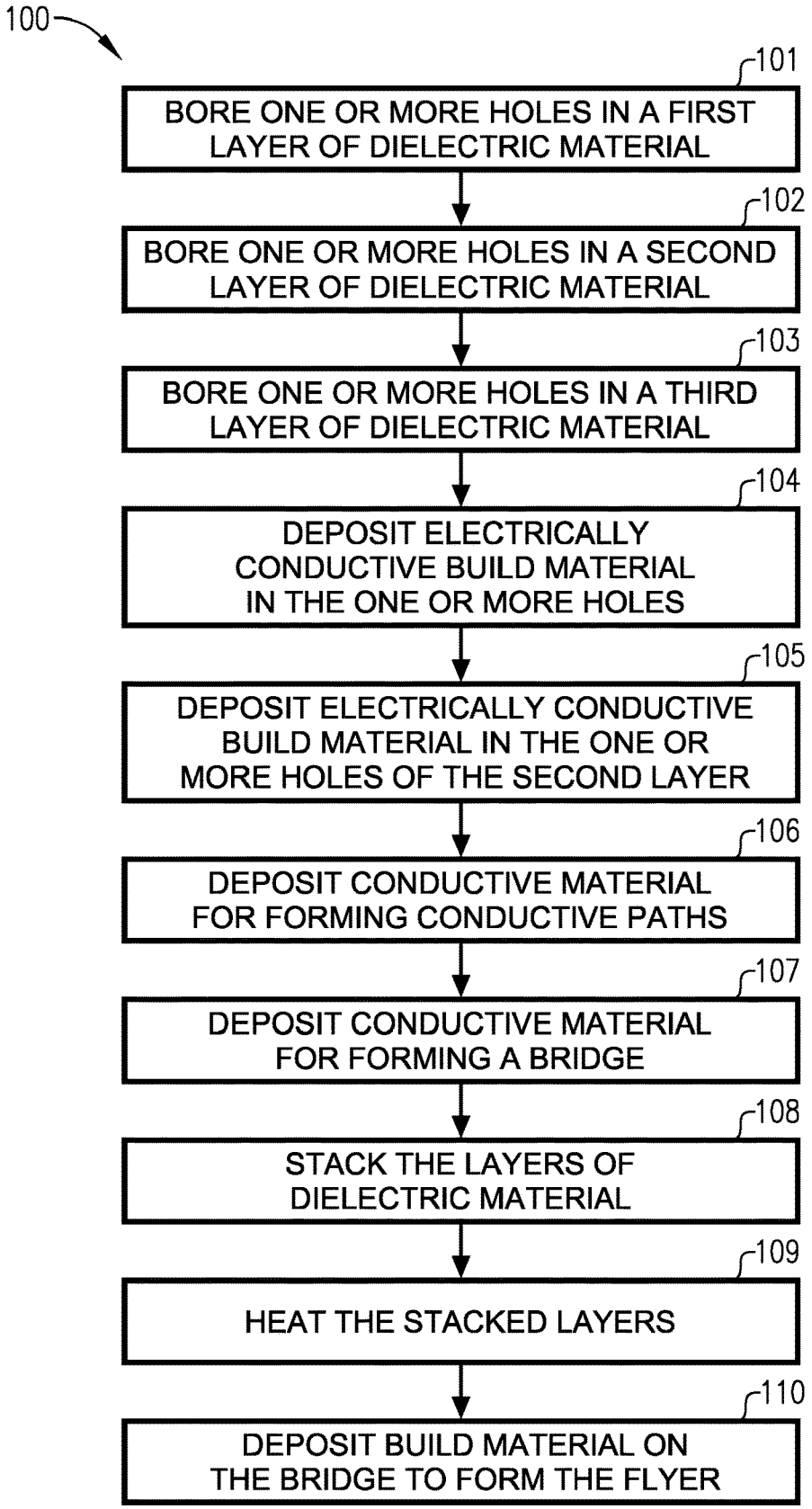
FIG. 7 is a flowchart illustrating a method of manufacturing an exploding foil initiator assembly according to an embodiment of the present invention.

The flow chart of FIG. 7 depicts the steps of an exemplary method 100 of manufacturing the above-described exploding foil initiator assembly 10 and other embodiments of the assembly 10. In some alternative implementations, the functions noted in the various blocks may occur out of the order depicted in FIG. 7. For example, two blocks shown in succession in FIG. 7 may in fact be executed substantially concurrently, or the blocks may sometimes be executed in the reverse order depending upon the functionality involved. In addition, some steps may be optional.

Referring to step 101, one or more holes are bored in a first layer of dielectric material. For example, the holes may be bored so that they extend from a first surface to a second surface of the first layer. The holes may have any size, shape, or orientation, including having any angle relative to the first and/or second surfaces without departing from the scope of the present invention. For example, the holes may be bored generally perpendicular to the surfaces of the first layer. The holes may also be bored so that they are located anywhere in the first layer. For example, the holes may be bored at a first distance apart from each other. Additionally, any number of holes may be bored in the first layer. The holes may be bored using a mechanical punch or laser.

Referring to step 102, one or more holes are bored in a second layer of dielectric material. For example, the holes may be bored so that they extend from the first surface of the second layer to the second surface of the second layer and have any size, shape, or orientation, including having any angle relative to the second surface of the first layer. For example, the holes of the second layer may be bored generally perpendicular to the surfaces of the second layer. The holes may also be bored so that they are located anywhere in the second layer. For example, to form staggered vias, the holes may be bored so that no part of the holes of the second layer would overlap the holes of the first layer if the first and second layers are stacked. Additionally, the holes may be bored a second distance apart from each other. The second distance may be different than the first distance (the distance between the holes in the first layer). For example, the second distance may be longer or shorter than the first distance. In some embodiments, the holes of the second layer may be bored so that at least a portion of the holes of the second layer would overlap the holes of the first layer if the first and second layers are stacked. The diameter of the holes of the second layer may be different than the diameter of the holes of the first layer. The holes may be bored using a mechanical punch or laser or other means.

Referring to step 103, a hole is bored in a third layer of dielectric material. For example, the hole may be bored so that it would be positioned above a bridge on the second layer when the third layer is stacked on the second layer. The hole may be bored all the way through the third layer so that it extends from a top surface of the third layer to a bottom surface of the third layer. In some embodiments, this step 103 may also include boring one or more holes in the third layer for forming vias or barrel.

Referring to step 104, electrically conductive build material is deposited in one or more of the holes of the first layer for forming a first pair of vias. The conductive build material may be deposited using stencil or screen printing, and the build material may comprise conductive paste. This step 104 may include drying the conductive build material.

Referring to step 105, electrically conductive build material is deposited in the holes of the second layer of dielectric material. The conductive build material may be deposited using stencil or screen printing, and the build material may comprise conductive paste. This step 105 may include drying the conductive build material.

Referring to step 106, conductive material is deposited for forming one or more conductive paths. The conductive material may be deposited for forming any length of conductive paths for connecting vias of different layers. The conductive material may be deposited on the second surface of the first layer and/or on the first surface of the second layer. The conductive material may be deposited so that at least a portion of it overlaps the conductive material deposited in the one or more holes of the first or second layer. The conductive material may comprise conductive paste. The conductive material may be deposited using thick film printing, thin film vapor deposition, or direct writing, such as aerosol jet printing. In embodiments where the dielectric material comprises co-fired ceramic, vapor deposition or aerosol jet printing of conductive material may occur after the step of heating (discussed below). This step 106 may include drying the conductive build material.

Referring to step 107, conductive build material is deposited on the second surface of the second layer to form a bridge and/or conductive trace or other components. This step 107 may also include using laser ablation to precisely dissipate portions of the bridge so that the bridge has a desired shape. The conductive material may be deposited for forming any length of conductive paths for connecting the vias on the second layer. The conductive material may be deposited on the second surface of the second layer so that at least a portion of it overlaps the conductive material deposited in the one or more holes of the second layer. The conductive material may comprise conductive paste. The conductive material may be deposited using thick film printing, thin film vapor deposition, or direct writing, such as aerosol jet printing. In embodiments where the dielectric material comprises co-fired ceramic, vapor deposition or aerosol jet printing of conductive material may occur after the step of heating (discussed below). This step 107 may include drying the conductive build material.

Referring to step 108, the layers of dielectric material are stacked and aligned. For example, the second layer may be stacked on the first layer of dielectric material, and the third layer may be stacked on the second layer. The second layer may be stacked so that the conductive material in its holes are aligned with the conductive material between the first and second layer for forming conductive paths. The third layer may be stacked on the second layer so that the hole of the third layer is aligned with the conductive material on the second layer for forming the bridge. This step 108 may include laminating the stacked layers together.

Referring to step 109, the stacked layers are heated. The stacked layers may be heated at temperatures high enough so that the dielectric material of the layers fuse together. The dielectric material of the layers may comprise ceramic material and/or a ceramic-loaded polymer.

The ceramic material may include high temperature co-fired ceramic or preferably low temperature co-fired ceramic. The ceramic material yields improved durability and insulation properties, which allow for higher electric currents to be used for initiation, thereby increasing the reliability of the assembly.

Referring to step 110, build material is deposited above the bridge to form the flyer. The build material of the flyer may be positioned directly on top of the bridge. The build material may be deposited so that the flyer forms any shape without departing from the scope of the present invention. For example, the flyer may comprise a flattened cylindrical shape. The build material forming the flyer may be a polymer and preferably comprises polyimide, parylene, or the like. The build material may be deposited via a direct write printer head, such as an extruder, or the like.

The method 100 may include additional, less, or alternate steps and/or device(s), including those discussed elsewhere herein.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. An exploding foil initiator assembly comprising:
- a first layer of dielectric material comprising—
  - a first surface, and
  - a second surface opposed to the first surface;
- a bridge positioned on the second surface;
- a second layer of dielectric material positioned adjacent to the second surface of the first layer and comprising a bore located at least partially over the bridge forming a barrel;
- a first via and a second via electrically connected to each other through the bridge;
- the first via extending along a first axis and the second via extending along a second axis, wherein each of the first via and the second via are located in one of the first layer or the second layer provided that the bridge is at least part of the electrical connection between the first via and the second via; and
- a flyer positioned in the barrel on the bridge.

2. The assembly of claim 1, further comprising a third layer of dielectric material positioned adjacent to the first surface of the first layer.

3. The assembly of claim 2, wherein the third layer comprises a third via extending along a third axis, the third via being electrically connected to the first via, and the third axis being spaced apart from the first axis at a first distance.

4. The assembly of claim 3, wherein the third layer comprises a fourth via extending along a fourth axis, the fourth via being electrically connected to the second via, and the fourth axis being spaced apart from the second axis at a second distance.

5. The assembly of claim 4, wherein the second layer covers the first via and the second via so that the first via and the second via are blind vias.

6. The assembly of claim 4, wherein the first distance is long enough so that no part of the first via overlaps the third via.

7. The assembly of claim 6, further comprising a conductive film positioned between the first layer and the third layer, the conductive film electrically connecting the first via to the third via.

8. The assembly of claim 4, wherein the first distance is different than the second distance.

9. The assembly of claim 1, wherein the first via and the second via are formed in the second layer.

10. The assembly of claim 1, wherein the first layer comprises a trench on the second surface, wherein the bridge is formed in the trench.

11. The assembly of claim 1, wherein the dielectric material comprises low temperature co-fired ceramic.

12. The assembly of claim 1, wherein the flyer comprises at least one of polyimide or parylene.

13. The assembly of claim 1, further comprising a pin attached to the first via.

14. A method of manufacturing an exploding foil initiator assembly, the method comprising:
- boring a hole in a first layer of dielectric material;
- depositing electrically conductive build material in the hole of the first layer;
- boring a hole in a second layer of dielectric material;
- depositing electrically conductive build material in the hole of the second layer;
- depositing electrically conductive build material on the second layer to form a bridge that is electrically connected to the second via;
- boring a hole in a third layer of dielectric material to form a barrel;
- arranging the first layer adjacent to the second layer so that the first via is electrically connected to the second via;
- arranging the second layer adjacent to the third layer so that the hole of the third layer is at least partially over the bridge to form a stack;
- heating the stack so that the first layer and third layer fuse to the second layer; and
- depositing a polymer on the bridge to form a flyer.

15. The method of claim 14, wherein the second via is in contact with the first via and a portion of the second layer.

16. The method of claim 15, wherein the first via and the second via are staggered relative to one another.

17. An exploding foil initiator assembly comprising:
- a first layer of dielectric material comprising a first via extending along a first axis;
- a second layer of dielectric material comprising—
  - a first surface adjacent to the first layer of dielectric material,
  - a second surface opposed to the first surface,
  - a second via extending from the first surface to the second surface along a second axis spaced apart from the first axis, the second via being electrically connected to the first via, and
  - a bridge positioned on the second surface and electrically connected to the second via;
- a third layer of dielectric material positioned on the second surface of the second layer and comprising a bore located at least partially over the bridge forming a barrel; and
- a flyer positioned in the barrel on the bridge.

18. The assembly of claim 17, wherein the first via and the second via are staggered.

19. The assembly of claim 17, further comprising a conductive material positioned between the first layer and second layer, the conductive material electrically connecting the first via to the second via.

20. The assembly of claim 17, wherein the dielectric material comprises low temperature co-fired ceramic.

* * * * *